US009525211B2

(12) United States Patent
Lee et al.

(10) Patent No.: US 9,525,211 B2
(45) Date of Patent: Dec. 20, 2016

(54) ANTENNA AND COMMUNICATION SYSTEM INCLUDING THE ANTENNA

(71) Applicants: SAMSUNG ELECTRONICS CO. LTD., Suwon-si (KR); AJOU UNIVERSITY INDUSTRY-ACADEMIC COOPERATION FOUNDATION, Suwon-si (KR)

(72) Inventors: Byung Moo Lee, Seoul (KR); Byung Chang Kang, Yongin-si (KR); Jong Ho Bang, Suwon-si (KR); Jin Do Byun, Suwon-si (KR); Hai-Young Lee, Seongnam-si (KR)

(73) Assignees: Samsung Electronics Co., Ltd., Suwon-si (KR); Ajou University Industry-Academic Cooperation Foundation, Suwon-si (KR)

( * ) Notice: Subject to any disclaimer, the term of this patent is extended or adjusted under 35 U.S.C. 154(b) by 128 days.

(21) Appl. No.: 14/146,159

(22) Filed: Jan. 2, 2014

(65) Prior Publication Data

US 2014/0184456 A1 Jul. 3, 2014

(30) Foreign Application Priority Data

Jan. 3, 2013 (KR) ..... 10-2013-0000679

(51) Int. Cl.

| | |
|---|---|
| ***H01Q 13/10*** | (2006.01) |
| ***H01Q 13/18*** | (2006.01) |
| ***H01Q 19/06*** | (2006.01) |

(52) U.S. Cl.
CPC ..... *H01Q 13/103* (2013.01); *H01Q 13/18* (2013.01); *H01Q 19/06* (2013.01)

(58) Field of Classification Search
CPC ..... H01Q 13/10; H01Q 13/18; H01Q 19/06; H01Q 9/0407; H01Q 1/38
See application file for complete search history.

(56) References Cited

U.S. PATENT DOCUMENTS

| | | | | |
|---|---|---|---|---|
| 4,933,679 | A * | 6/1990 | Khronopulo | H01Q 21/068 343/700 MS |
| 5,241,321 | A * | 8/1993 | Tsao | H01Q 9/0435 343/700 MS |
| 5,245,745 | A * | 9/1993 | Jensen | H01Q 9/0407 29/600 |
| 5,262,791 | A * | 11/1993 | Tsuda | H01Q 5/42 343/700 MS |
| 5,446,471 | A | 8/1995 | Chung et al. | |
| 6,075,493 | A | 6/2000 | Sugawara et al. | |
| 6,160,522 | A | 12/2000 | Sanford | |
| 6,225,959 | B1 | 5/2001 | Gordon | |
| 6,304,226 | B1 | 10/2001 | Brown et al. | |

(Continued)

FOREIGN PATENT DOCUMENTS

| | | |
|---|---|---|
| JP | 2012-90257 | 5/2012 |
| KR | 10-2010-0109151 | 10/2010 |

*Primary Examiner* — Hoang V Nguyen
(74) *Attorney, Agent, or Firm* — NSIP Law

(57) ABSTRACT

An antenna and a communication system with the antenna are provided. The antenna may include a first layer including a plurality of folded stubs, a second layer including a pattern of the folded stubs, and a third layer connected to ground is disposed between the first layer and the second layer.

18 Claims, 10 Drawing Sheets

(56) References Cited

U.S. PATENT DOCUMENTS

| | | | | |
|---|---|---|---|---|
| 6,642,889 | B1 * | 11/2003 | McGrath | H01Q 1/38 343/700 MS |
| 7,176,842 | B2 * | 2/2007 | Bettner | H01Q 9/14 343/702 |
| 8,009,104 | B2 * | 8/2011 | Hossain | H01Q 3/44 343/700 MS |
| 8,780,007 | B2 * | 7/2014 | Tseng | H01Q 1/243 343/876 |
| 8,878,738 | B2 * | 11/2014 | Chang | H01Q 23/00 343/745 |
| 2001/0050641 | A1 | 12/2001 | Itoh et al. | |
| 2003/0122721 | A1 | 7/2003 | Sievenpiper | |
| 2004/0174314 | A1 | 9/2004 | Brown | |
| 2011/0018657 | A1 | 1/2011 | Cheng et al. | |
| 2011/0241948 | A1 | 10/2011 | Bevelacqua et al. | |
| 2011/0273351 | A1 | 11/2011 | Johnson | |
| 2012/0280770 | A1 | 11/2012 | Abhari et al. | |
| 2012/0293279 | A1 | 11/2012 | Gong et al. | |

* cited by examiner

| Name | Theta | Ang | Mag |
|---|---|---|---|
| m1 | -180.0000 | -180.0000 | -9.2539 |
| m2 | 180.0000 | 180.0000 | -2.7866 |

ANTENNA AND COMMUNICATION SYSTEM INCLUDING THE ANTENNA

CROSS-REFERENCE TO RELATED APPLICATIONS

This application claims the benefit under 35 USC §119(a) of Korean Patent Application No. 10-2013-0000679, filed on Jan. 3, 2013, in the Korean Intellectual Property Office, the entire disclosure of which is incorporated herein by reference for all purposes.

BACKGROUND

1. Field

The following description relates to an antenna including folded stubs and a communication system including the antenna.

2. Description of Related Art

A slot antenna is configured such that a thin and long aperture is formed through a flat conductive plate to permit radio waves to be radiated from the aperture. The slot antenna has bi-directional radiation characteristics. To improve the bi-directional radiation characteristics of the slot antenna, a cavity back slot antenna (CBSA) has been suggested, in which a cavity having a ¼ length of wavelength is connected in one direction of the slot antenna.

Recently, a substrate integrated waveguide (SIW) capable of obtaining transmission characteristics of a metal guide in a printed circuit board (PCB) has been suggested. The SIW has properties of low loss of a waveguide, radiation characteristics based on a closed structure, and high power transmission efficiency. To utilize those properties, a SIW CBSA is introduced, in which the cavity of the CBSA is replaced by a SIW cavity. The SIW CBSA is reduced in thickness and increased in integration efficiency with respect to other devices.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided

Other features and aspects will be apparent from the following detailed description, the drawings, and the claims.

Figure 1:
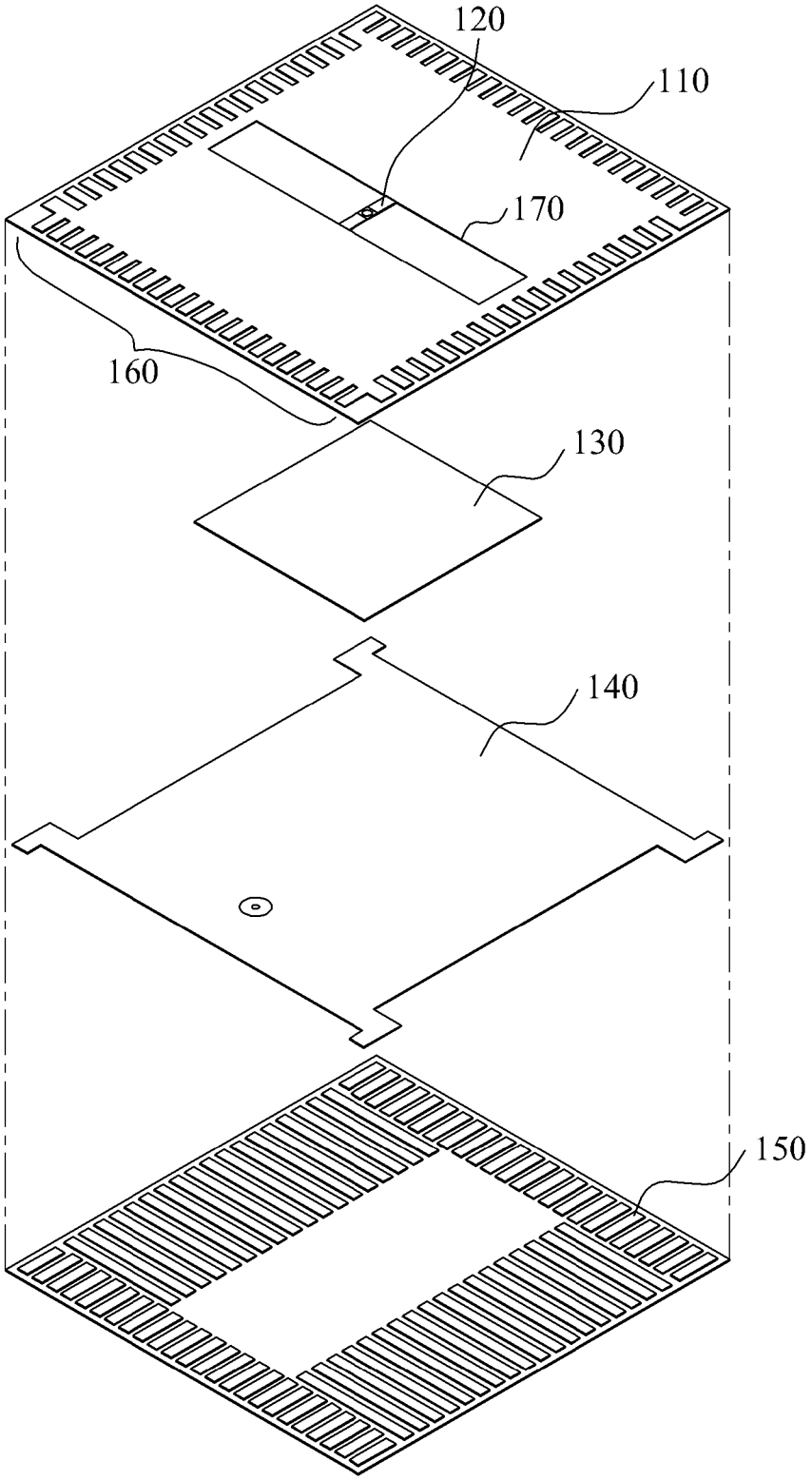
FIG. 1 is a diagram illustrating an example of a configuration of an antenna.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

FIG. 1 is a diagram illustrating an example of a configuration of an antenna. For example, the antenna may be a substrate integrated waveguide (SIW) cavity back slot antenna (CBSA) configured by replacing a cavity of a CBSA with an SIW cavity. A whole size of the antenna may be, for example, a free space wavelength of about 0.37 by 0.37 of an operating frequency.

Referring to FIG. 1, the cavity may include a plurality of layers. A first layer 110 may include a plurality of stubs 160 for implementing a virtual shorting via hole. The stubs 160 may have a folded structure. For example, the stubs 160 may be folded into a flattened U-shape. In a non-exhaustive example when the antenna is in a rectangular parallelepiped shape, the folded stubs 160 may be arranged at an outer portion of the rectangular parallelepiped in four directions. In each of the four directions, the stubs 160 may be arranged at uniform intervals to form a comb-teeth shaped structure.

Because the stubs 160 have a folded structure, the antenna may be designed in a smaller size, which is efficient for a large array antenna system such as a multiple-input and multiple-output (MIMO) system. When the stubs 160 having the folded structure are used, a high front-to-back ratio (FTBR) of an antenna may be achieved. The antenna may include the first layer 110 including the folded stubs 160 and a second layer 150 including a pattern of the folded stubs 160. In this case, an effect of dielectric capacitance loading may be obtained. As a consequence, one-fourth of the physical length of a guided wavelength may be reduced.

The first layer 110 may include a slot aperture 170 for radiation of radio waves. The folded stubs 160 included in the first layer 110 may have about one-fourth of the length of the guided wavelength in the operating frequency. For example, in case of the antenna using the SIW, the folded stubs 160 for functioning as shorting via holes may have about one-fourth of the length of the guided wavelength in the operating frequency.

The folded stubs 160 may all be of identical lengths or may be of two different lengths. When all the folded stubs 160 have the same length, the antenna may operate in a particular frequency band corresponding to the length of the folded stubs 160. When the folded stubs 160 have two different lengths, the antenna may operate in frequency bands corresponding to the two lengths of the folded stubs 160, thereby providing characteristics of a wider frequency band.

In a non-exhaustive example, as shown in FIG. 1, the folded stubs 160 may be arranged at the periphery of the antenna, with the folded stubs 160 pointing out in four directions. The folded stubs 160 may include top stubs directed to an upper portion, bottom stubs directed to a lower portion, left stubs directed to a left portion, and right stubs directed to a right portion. The top stubs and the bottom stubs are of identical length while the left stubs and the right stubs are of identical length. The length of the top stubs and the bottom stubs may be different and the length of the left stubs and the right stubs may be different. Depending on the length of the stubs, an operating frequency of the top stubs and an operating frequency of the left stubs may be different from each other. Accordingly, the antenna may provide wideband characteristics. In addition, the top stubs and the bottom stubs may increase the FTBR, by controlling propagation and diffraction of the antenna near an edge of a tangential H-field in a near field radiometer.

The first layer 110 may be used for direct current (DC) biasing. The first layer 110 may be electrically insulated from a third layer 140, which may be connected to a ground. The first layer 110 may be connected with the second layer 150 by a feeding via. The feeding via may function as a signal feeding via. Accordingly, the antenna may perform DC biasing by itself.

In addition, since the stubs are folded and the first layer 110 is separated from the third layer 140, which functions as a grounding layer, the antenna may operate even without a dedicated power layer and power wiring for supplying power. Thus, the antenna may be supplied with power in any position.

The second layer 150 may include a folding pattern of the folded stubs 160 of the first layer 110. The folding pattern is disposed in an inward direction of the antenna. The second layer 150 may be connected with the first layer 110 by the feeding via. The feeding via may be arranged perpendicularly to the layers included in the antenna. Power supply may be achieved through the feeding via in a transverse electromagnetic mode (TEM).

Figure 2:
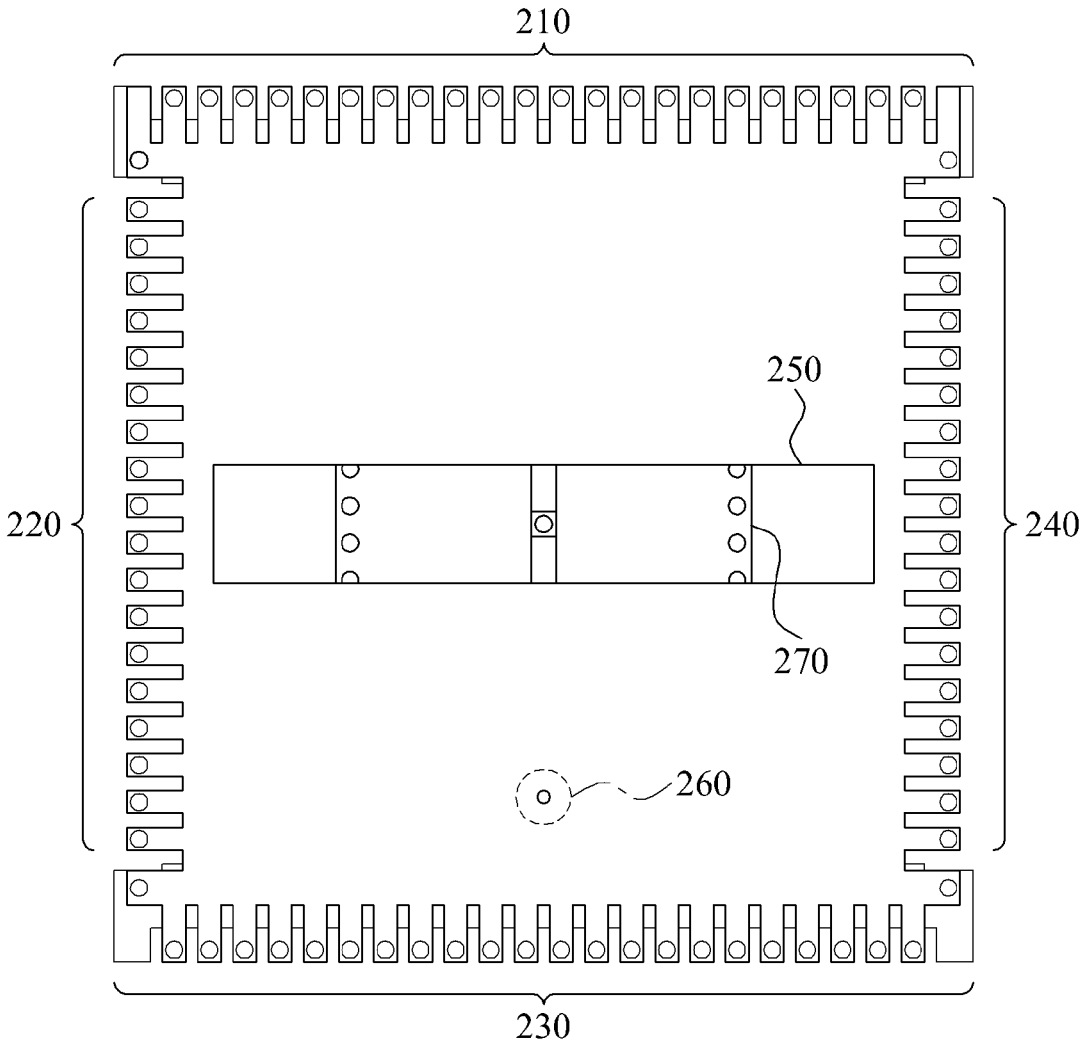
FIG. 2 is a diagram illustrating an example of an antenna.

According to FIG. 1, the folded stubs 160 have two different lengths, thus the length of the pattern of the folded stubs 160 included in the FIG. 2 are not all equal. In the second layer 150, patterns of the top stubs and the bottom stubs are shorter than patterns of the left stubs and the right stubs.

The third layer 140 is disposed between the first layer 110 and the second layer 150, and the third layer is connected to the ground. To prevent a short circuit with respect to the folded stubs 160 of the first layer 110, the third layer 140 may be formed smaller than a space enclosed by the folded stubs 160.

The third layer 140 may be electrically insulated from the first layer 110 and the second layer 150. The third layer 140 may form a cavity structure by being separated from the first layer 110.

A diode may vary the operating frequency based on a position in the antenna or a magnitude of an applied voltage. For example, the diode may be a varactor diode adapted to vary the operating frequency based on changing the capacitance according to an applied voltage. The diode may be disposed at an upper portion 120 of the slot aperture 170 of the first layer 110. The antenna may provide tunability with respect to the operating frequency or an oscillating frequency using the diode. Accordingly, the antenna may cover various communication bands.

The diode may be connected in parallel with a slot disposed in the first layer 110 of the antenna. A position of the diode on the antenna may be determined in consideration of field distribution of a TE102 mode, which is a slot operating mode.

According to another example, a fourth layer 130 in the form of a ridge may be disposed between the first layer 110 and the third layer 140. When the antenna includes the fourth layer 130, the radiation efficiency of the antenna may be increased by the ridge form of the fourth layer 130.

The fourth layer 130 may be connected to the third layer 140 through a ground via. Therefore, the fourth layer 130 may be grounded in the same manner as the third layer 140. The fourth layer 130 may form the cavity structure, by being separated from the first layer 110. When the antenna includes the fourth layer 130, the diode may be applied to the fourth layer 130 in a parallel manner. The first layer 110 may be electrically insulated from the fourth layer 130.

FIG. 2 is a diagram illustrating an example of an antenna. FIG. 2 shows the top-view of the antenna. When seen from above, the antenna is rectangular in shape and includes folded stubs arranged at the periphery of the antenna, with the folded stubs 160 pointing out in four directions. The antenna may include top folded stubs 210, bottom folded stubs 230, left folded stubs 220, and right folded stubs 240. Each of the folded stubs may have about one-fourth the length of a guided wavelength in an operating frequency. The antenna may include a slot aperture 250 and a feeding via 260 for interconnection of layers. A fourth layer 270 in the form of a ridge is shown through the slot aperture 250.

Figure 3:
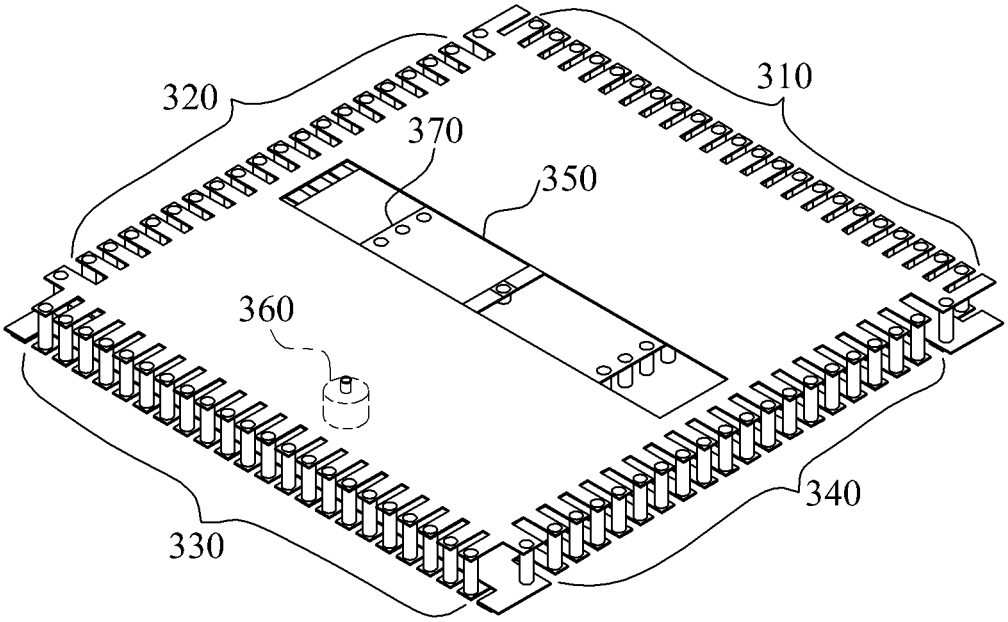
FIG. 3 is a diagram illustrating an example of an antenna.

FIG. 3 is a diagram illustrating an example of an antenna seen from another view.

Referring to FIG. 3, the antenna is shown in a diagonal direction from a space. The antenna may include top folded stubs 310, bottom folded stubs 330, left folded stubs 320, and right folded stubs 340. The antenna may also include a slot aperture 350 and a feeding via 360 for power supply for the antenna. A fourth layer 370 in the form of a ridge is shown through the slot aperture 350. The fourth layer 370 may form a cavity structure with a first layer.

Figure 4A:
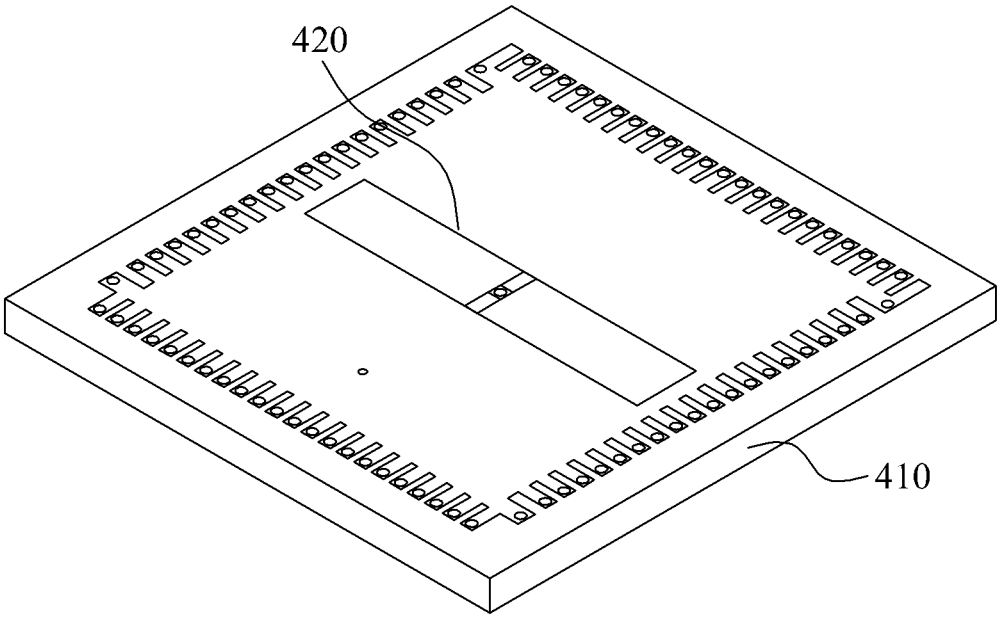
FIGS. 4A and 4B are diagrams illustrating examples of an antenna being substantiated.
Figure 4B:
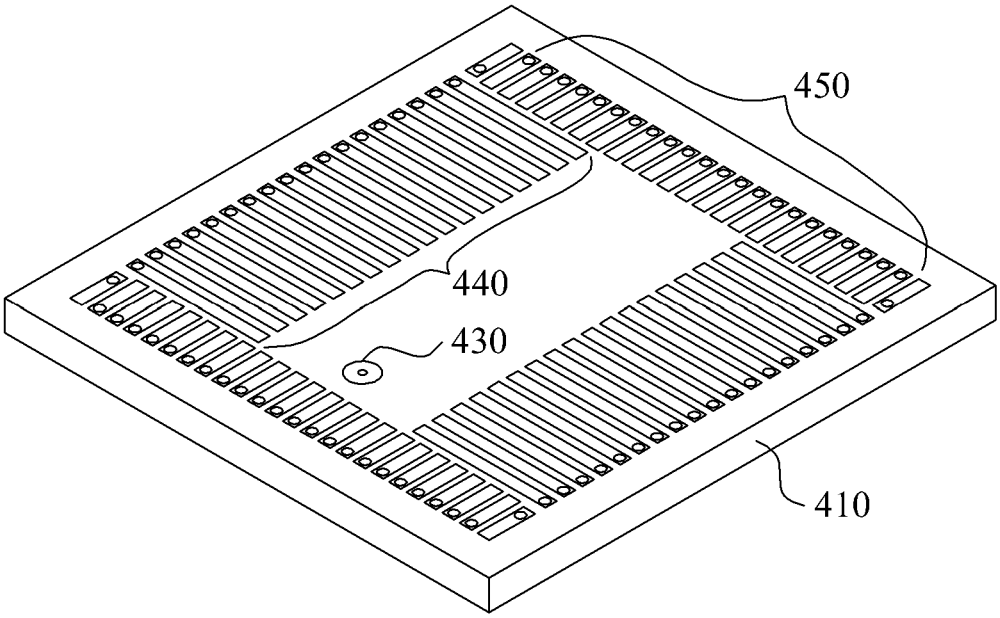

FIGS. 4A and 4B are diagrams illustrating examples of an antenna being substantiated. FIG. 4A shows an upper side of the substantiated antenna. FIG. 4B shows a lower side of the substantiated antenna. The substantiated antenna may include a substrate 410. The antenna may be disposed in the substrate. A slot aperture 420 is shown at the upper side of the antenna. A feeding via 430 for power supply is shown at the lower side of the antenna. The lower side of the antenna includes patterns of folded stubs. Since a pattern 440 of the left folded stubs is shown to be longer than a pattern 450 of the upper folded stubs, length of the upper folded stubs may be different from length of the left folded stubs. Accordingly, the antenna may provide wideband characteristics enabling operation at two operating frequencies.

Figure 5:
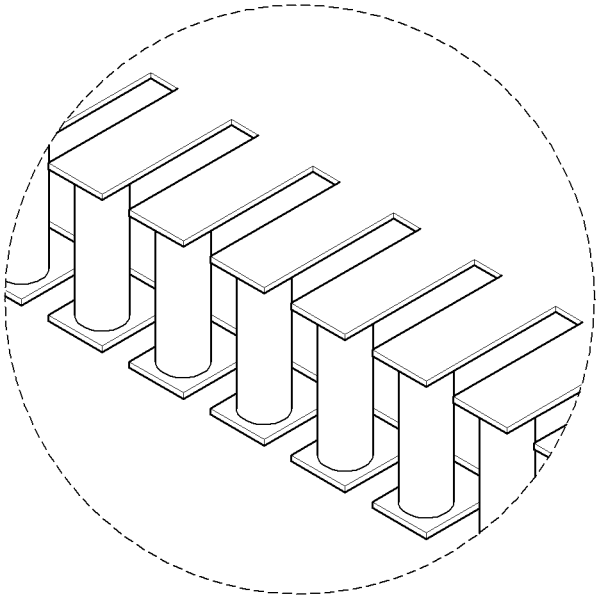
FIG. 5 is a diagram illustrating an example of folded stubs.

FIG. 5 is a diagram illustrating an example of folded stubs in an enlarging manner.

Referring to FIG. 5, the stubs may be folded into a flattened U-shape pattern, thereby connecting a first layer with a second layer. The folded stubs are arranged at uniform intervals to form a structure shaped like the teeth of a comb. The folded structure of the stubs enable the size of the antenna to be reduced. In the present example, the folded stubs of FIG. 5 include a cylindrical structure. However, since this is only a non-exhaustive example, various other shapes may be applied.

Figure 6:
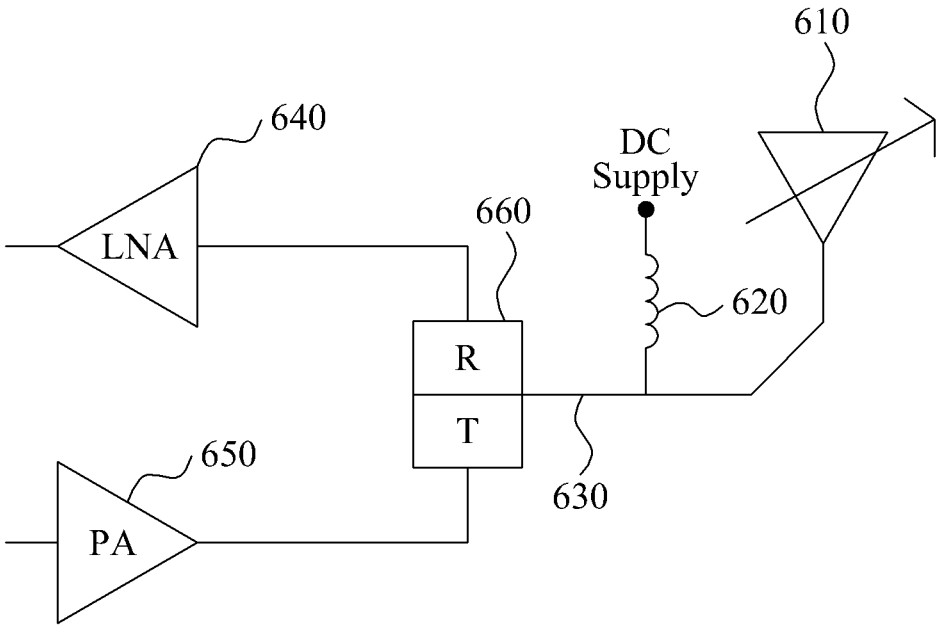
FIG. 6 is a diagram illustrating an example of a configuration of a communication system.

FIG. 6 is a diagram illustrating an example of a communication system.

Referring to FIG. 6, the communication system may include an antenna 610 including a plurality of folded stubs, and a signal processing circuit to process a signal transmitted via the antenna 610. The signal processing circuit may include a power amplifier (PA) 640, a low noise amplifier (LNA) 650, and a signal transmitter 660. The PA 640 may amplify a signal to be transmitted. The LNA 650 may minimize a noise of a received signal and amplify the received signal. The signal transmitter 660 may be connected with the antenna 610 to transmit or receive the signal to or from the antenna 610.

In addition, the communication system may include a radio frequency choke (RFC) connected to a line 630 for connecting the antenna 610 with the signal processing circuit. The RFC may interrupt an RF alternating current (AC) signal from flowing to a DC power supply.

As described above, the antenna 610 may include a first layer for DC biasing, a second layer including a pattern of folded stubs of the first layer, and a third layer disposed between the first layer and the second layer and electrically insulated from the first layer.

The first layer may include a plurality of stubs for forming a virtual shorting via. The plurality of stubs may have a folded structure. Because of the folded structure, the antenna 610 may be manufactured in a smaller size. In addition, the FTBR of the antenna 610 may be increased due to the folded stubs. Since the antenna 610 includes the first layer including the folded stubs and the second layer including the pattern of the folded stubs, a capacitance loading effect of a dielectric substance may be obtained. Consequently, physical length of the guided wavelength may be reduced to about one-fourth. The first layer may include a slot aperture for radiation of radio waves.

The folded stubs of the first layer may be about one-fourth the length of the guided wavelength at the operating frequency. The folded stubs may be all in same length or in two different lengths. When the length of the folded stubs are all the same, the antenna may operate in a particular frequency band corresponding to the length of the folded stubs. When the folded stubs have two different lengths, the antenna may operate in frequency bands corresponding to the lengths of the folded stubs, thereby providing characteristics of a wider frequency band.

The first layer may be used for DC biasing. The first layer may be electrically insulated from a third layer connected to a ground. The first layer may be connected with the second layer by a feeding via. The feeding via may function as a signal feeding via. Accordingly, the antenna may perform DC biasing by itself.

Since the stubs have the folded structure and the first layer is separated from the third layer, which functions as a grounding layer, the antenna 610 may operate even without a dedicated power layer and power wiring for applying power. Thus, the antenna 610 may be supplied with power in any position.

The second layer may include a pattern of the folded stubs. The second layer may include a folding pattern of the stubs of the first layer. The folding pattern is disposed inwardly of the antenna 610. The second layer may be connected with the first layer by the feeding via. The feeding via may be arranged perpendicularly to layers included in the antenna. Power supply may be achieved through the feeding via in a TEM.

The third layer may be disposed between the first layer and the second layer, and the third layer may be connected to the ground. To prevent a short circuit with respect to the folded stubs of the first layer, the third layer may be formed smaller than a space enclosed by the folded stubs. The third layer may be electrically insulated from the first layer and the second layer. The third layer may form a cavity structure by being separated from the first layer.

The diode may vary the operating frequency based on a position in the antenna 610 or a magnitude of an applied voltage. For example, the diode may be a varactor diode adapted to vary the operating frequency based on changing the capacitance according to an applied voltage. To operate the varactor diode, a reverse voltage needs to be applied. The communication system may operate the varactor diode by applying the reverse voltage to an RF signal line through an RFC. Accordingly, the antenna 610 may operate with tunability using the diode without a dedicated layer for supplying power.

The diode may be connected in parallel with a slot disposed in the first layer of the antenna 610. A position of the diode on the antenna 610 may be determined in consideration of field distribution of a TE102 mode, which is a slot operating mode. The antenna 610 may provide tunability with respect to the operating frequency or an oscillating frequency using the diode. Accordingly, the communication system may cover various communication bands.

According to another non-exhaustive example, the antenna 610 may further include a fourth layer in the form of a ridge disposed between the first layer and the third layer. The radiation efficiency of the antenna 610 may be increased by the ridge form of the fourth layer.

The fourth layer may be connected with the third layer through a ground via. Therefore, the fourth layer may be grounded in the same manner as the third layer. The fourth layer may form the cavity structure, by being separated from the first layer. When the antenna includes the fourth layer, the diode may be applied to the fourth layer in a parallel manner. The first layer may be electrically insulated from the fourth layer.

Figure 7:
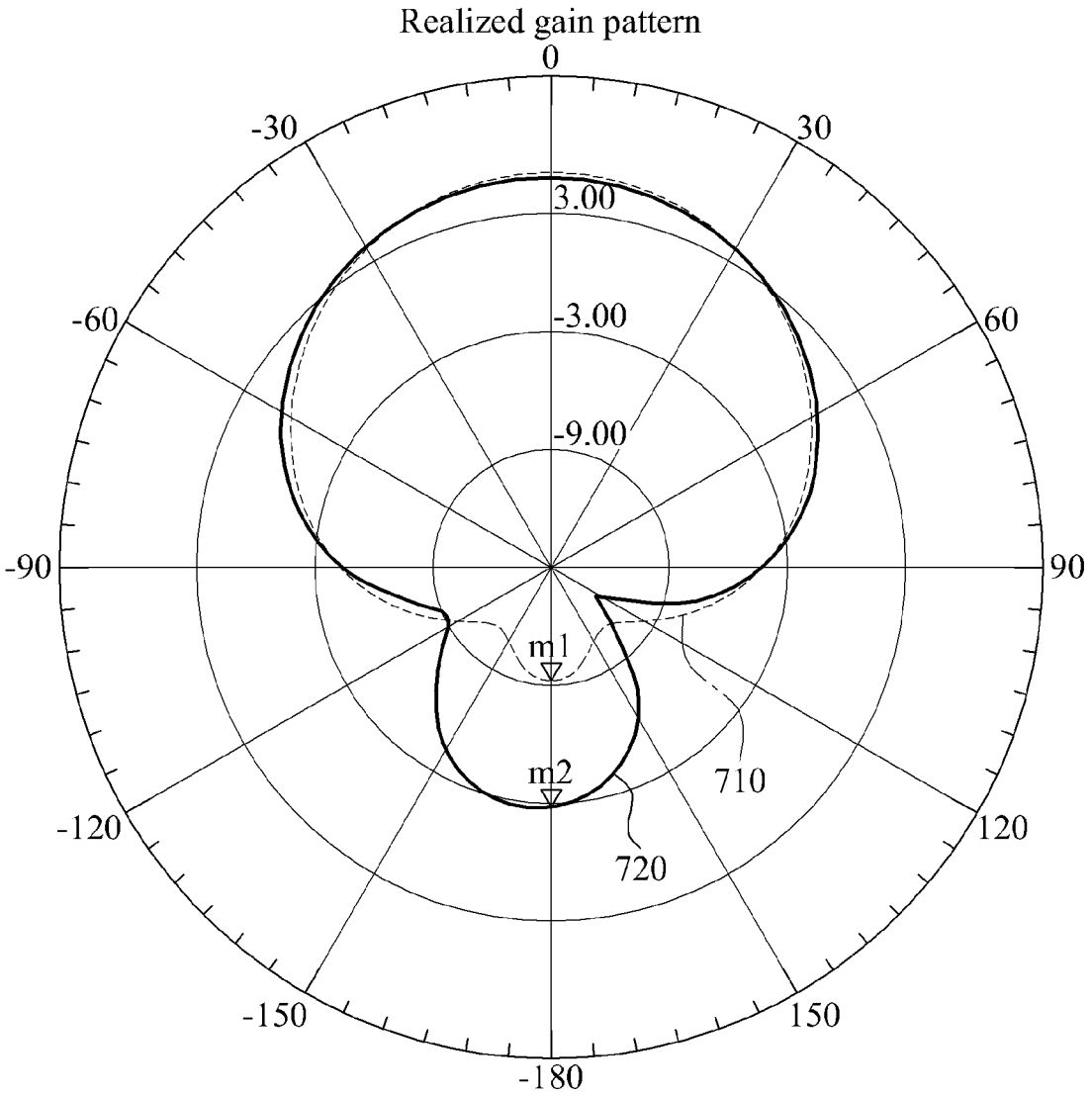
FIG. 7 is a diagram illustrating an example of a simulation result related to a radiation pattern of an antenna.

FIG. 7 is a diagram illustrating an example of a simulation result related to a radiation pattern of an antenna. FIG. 7 shows the simulation result of comparing a gain pattern 720 of an antenna not including folded stubs with reference to an E-surface parallel with an E-field with a gain pattern 710 of an antenna including folded stubs. It may be understood from the simulation result that loss of power caused by backward radiation is reduced and the FTBR is increased when the folded stubs are included compared to when the folded stubs are not included.

Figure 8:
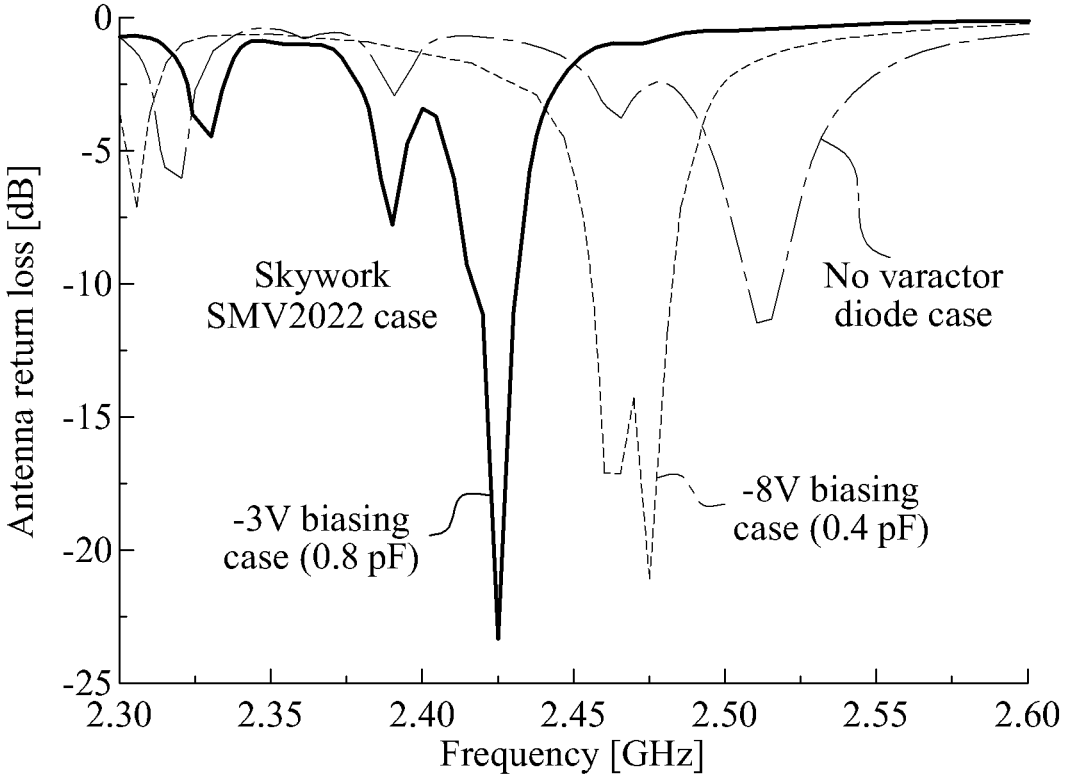
FIG. 8 is a diagram illustrating an example of a simulation result related to reflective loss of an antenna including a diode.

FIG. 8 is a diagram illustrating an example of a simulation result related to reflective loss of an antenna including a diode. FIG. 8 shows the simulation result of comparing a reflective loss of an antenna including a varactor diode as the diode and a reflective loss of an antenna not including a varactor diode. As can be appreciated from the simulation result, the antenna using the varactor diode through DC biasing shows higher tunability and characteristics of a wider band.

Figure 9:
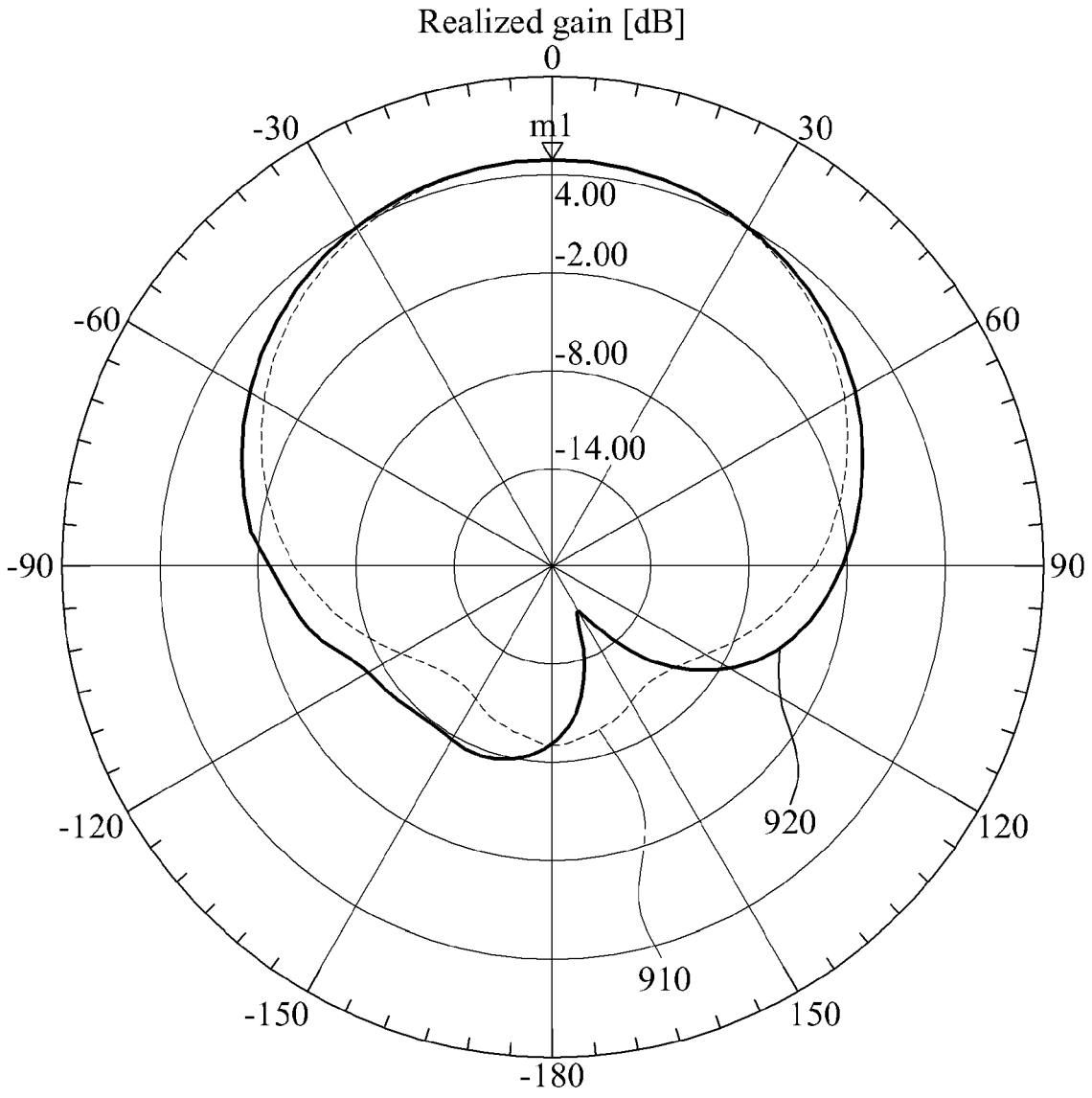
FIG. 9 is a diagram illustrating an example of a simulation result related to a radiation pattern of an antenna at an E-surface and an H-surface.

FIG. 9 is a diagram illustrating an example of a simulation result related to a radiation pattern of an antenna at an E-surface and an H-surface parallel with an H-field. In FIG. 9, a radiation pattern at a center frequency of the antenna is shown as a result of 3D far-field simulation using high frequency structural simulator (HFSS). As can be appreciated from a gain pattern 910 of the E-surface and a gain pattern 920 of the H-surface, FTBR is increased in comparison to a conventional ridged SIW (RSIW) CBSA antenna.

Figure 10:
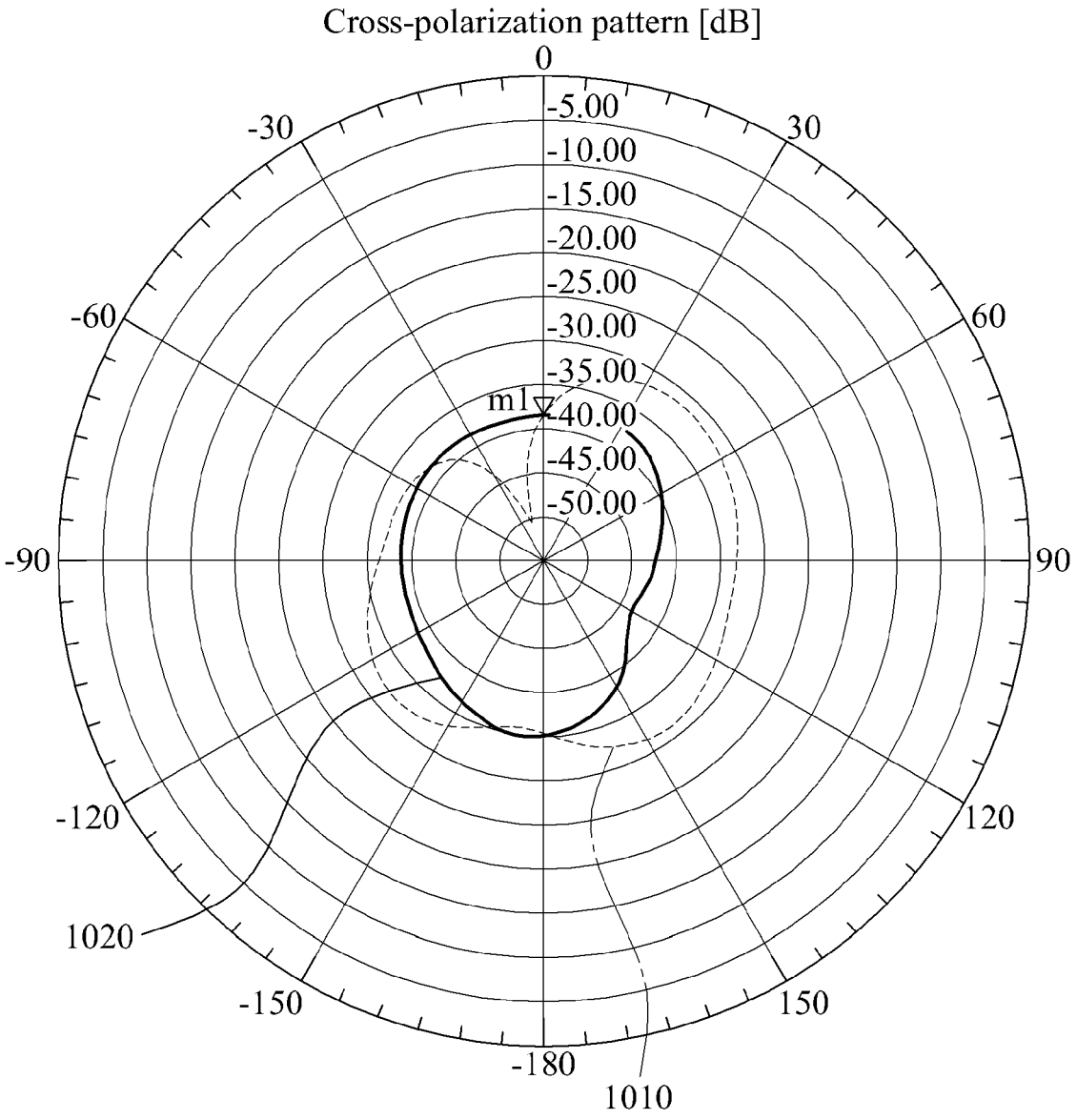
FIG. 10 is a diagram illustrating an example of a simulation result related to an X-polarization radiation pattern.

FIG. 10 is a diagram illustrating an example of a simulation result related to an X-polarization radiation pattern. As the far-field simulation result, FIG. 10 shows a simulation result 1010 of an E-surface and a simulation result 1020 of an H-surface. Since both simulation results 1010 and 1020 show values of about −30 dBi or lower, it is understood that the suggested antenna interrupts most unnecessary signal input.

The methods described above can be written as a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device that is capable of providing instructions or data to or being interpreted by the processing device. The software also may be distributed over network coupled computer systems so that the software is stored and executed in a distributed fashion. In particular, the software and data may be stored by one or more non-transitory computer readable recording mediums. The non-transitory computer readable recording medium may include any data storage device that can store data that can be thereafter read by a computer system or processing device. Examples of the non-transitory computer readable recording medium include read-only memory (ROM), random-access memory (RAM), Compact Disc Read-only Memory (CD-ROMs), magnetic tapes, USBs, floppy disks, hard disks, optical recording media (e.g., CD-ROMs, or DVDs), and PC interfaces (e.g., PCI, PCI-express, WiFi, etc.). In addition, functional programs, codes, and code segments for accomplishing the example disclosed herein can be construed by programmers skilled in the art based on the flow diagrams and block diagrams of the figures and their corresponding descriptions as provided herein.

The apparatuses and units described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a hardware component may include multiple processors or a processor and a controller. In addition, different processing configurations are possible, such a parallel processors.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna comprising:

a first layer comprising stubs;

a second layer comprising a pattern of the stubs;

a third layer connected to ground and disposed between the first layer and the second layer, and a fourth layer in the form of a ridge and disposed between the first layer and the second layer.

2. The antenna of claim 1, wherein the stubs are of at least two different lengths.

3. The antenna of claim 1, wherein the length of the stubs is one-fourth of a guided wavelength.

4. The antenna of claim 1, wherein the stubs are arranged along an outer portion of the antenna and point outwards in four directions.

5. The antenna of claim 1, wherein the first layer is connected to the second layer by a feeding via.

6. The antenna of claim 1, wherein the third layer is electrically insulated from the first layer and the second layer.

7. The antenna of claim 1, wherein the fourth layer is connected with the third layer by a ground via and is separated from the first layer.

8. The antenna of claim 1, further comprising a diode configured to vary an operating frequency based on at least one of a position on the antenna or a magnitude of an applied voltage.

9. The antenna of claim 8, wherein the diode is connected in parallel with a slot of the antenna, the slot being disposed in the first layer.

10. The antenna of claim 1, wherein the third layer is smaller than the first and the second layers.

11. The antenna of claim 1, wherein the stubs are folded into a flattened U-shape.

12. The antenna of claim 11, wherein the stubs are arranged at uniform intervals to form a comb-teeth shaped structure.

13. An antenna comprising:

a first layer comprising stubs;

a second layer comprising a pattern of the stubs; and a third layer connected to ground and disposed between the first layer and the second layer, wherein the third layer is separated from the first layer to form a cavity structure.

14. A communication system comprising:

an antenna comprising a first layer comprising stubs;

a second layer comprising a pattern of the stubs of the first layer; and a third layer electrically insulated from the first layer and the second layer and connected to ground; and a signal processing circuit configured to process a signal transmitted through the antenna, wherein the first layer is configured to perform direct current (DC) biasing.

15. The communication system of claim 14, wherein the stubs are of at least two different lengths.

16. The communication system of claim 14, wherein the antenna further comprises a fourth layer in the form of a ridge, the fourth layer being disposed between the first layer and the second layer and being separated from the first layer.

17. The communication system of claim 14, wherein the antenna comprises a diode configured to vary an operating frequency based on at least one of a position on the antenna or a magnitude of an applied voltage.

18. The communication system of claim 14, further comprising a radio frequency choke (RFC) disposed between the antenna and the signal processing circuit.

* * * * *